US005257315A

United States Patent [19]

Haertl et al.

[11] Patent Number: 5,257,315

[45] Date of Patent: Oct. 26, 1993

[54] HEARING AID TO BE WORN IN THE EAR

[75] Inventors: Christof Haertl, Neunkirchen; Jochen Mueller, Munich, both of Fed. Rep. of Germany

[73] Assignee: Siemens Aktiengesellschaft, Munich, Fed. Rep. of Germany

[21] Appl. No.: 887,872

[22] Filed: May 26, 1992

[30] Foreign Application Priority Data

Jun. 27, 1991 [DE] Fed. Rep. of Germany ..... 4121312

[51] Int. Cl.[5] ..... H04R 25/00

[52] U.S. Cl. ..... 381/68.6; 381/68; 381/69; 361/728

[58] Field of Search ..... 381/68, 68.6, 68.2, 381/68.4, 69, 69.2, 68.7; 455/351; 361/392, 394, 395, 399, 417, 419, 420, 401

[56] References Cited

U.S. PATENT DOCUMENTS

| | | | |
|---|---|---|---|
| 4,471,490 | 9/1984 | Bellafiore | 381/69 |
| 4,476,353 | 10/1984 | Haertl | 381/68.6 |
| 4,578,739 | 3/1986 | McKee et al. | 455/351 |
| 4,634,815 | 1/1987 | Marquis | 381/68.6 |
| 4,937,876 | 6/1990 | Biërmans | 381/68.6 |
| 4,987,597 | 1/1991 | Haertl | 381/69 |
| 5,008,943 | 4/1991 | Arndt et al. | 381/68.6 |

FOREIGN PATENT DOCUMENTS

| | | |
|---|---|---|
| 8106942 | 8/1982 | Fed. Rep. of Germany . |
| 8713369 | 3/1989 | Fed. Rep. of Germany . |
| 3309175 | 8/1992 | Fed. Rep. of Germany . |
| 662026 | 8/1987 | Switzerland . |
| 8606919 | 11/1986 | World Int. Prop. O. . |

*Primary Examiner*—Jin F. Ng
*Assistant Examiner*—Huyen D. Le
*Attorney, Agent, or Firm*—Hill, Steadman & Simpson

[57] ABSTRACT

An in-the-ear hearing aid comprises a housing having a face plate that has a first opening for a battery compartment and a second opening connected to the first opening. A lamina is constructed as a carrier for a hearing aid component and is introduced into this second opening, and the lamina is secured in this second opening, even when the battery is removed from the battery compartment, and is, nonetheless, removable from the hearing aid without exertion of great force. To accomplish these goals, a holding arrangement is formed in a portion of the edges of the lamina and the second opening.

11 Claims, 2 Drawing Sheets

HEARING AID TO BE WORN IN THE EAR

BACKGROUND OF THE INVENTION

The present invention is directed to an in-the-ear hearing aid comprising a housing with a face plate that has a first opening for a battery compartment to which a second opening is connected and a lamina or plate-like member which forms a carrier for hearing aid components is received in this second opening.

In commercially-available hearing aids of the above type, a lamina or small thin plate is fashioned approximately triangularly. One edge of this lamina or plate simultaneously forms an edge of an opening of the battery compartment and carries a battery contact spring which extends perpendicular to the plane of the lamina to form a side wall of the battery compartment that is also fashioned as a spring. A corner of the lamina that is fashioned considerably rounded lies opposite this edge having the contact spring for the battery. The rounded edge of the lamina carries a control element and is arranged neighboring the tragus and the antitragus of an ear. This position for the control element makes the actuation of the control element more difficult.

With the exception of the edge of the lamina limiting the opening of the battery compartment, all other edges of the lamina comprise abutting surfaces that reside or extend perpendicular vis-a-vis the plane of the lamina and correspond with other abutting surfaces of the face plate. All abutting surfaces have weakly fashioned contours similar to a channel spring connection. A form-fit seat of the lamina in the face plate is, thus, only achieved to the effect that the surface of the face plate coincides with the level of the surface of the lamina. The lamina, however, only remains in this intended position when the battery charger or a battery is inserted into the battery compartment and presses against the lamina via the battery contact spring fashioned as a side wall of the battery compartment. The abutting surfaces are thereby held against one another. The abutting surfaces can, thus, separate from one another, given the frequently required replacement of the respectively used battery. The lamina can then fall into the inside of the hearing aid housing. As a result thereof and due to the required adjustment of the lamina in the second opening, expensive hearing aid components can be damaged, particularly when these jobs are carried out by an untrained hearing aid user by himself. In order to eliminate these deficiencies, the abutting surfaces have already been spot-glued to one another. As a result thereof, a person skilled in the art can only remove the lamina from the hearing aid for repair work at the hearing aid after overcoming the relatively great adhesion. This exertion of force can, in turn, lead to damage to hearing aid components. The manipulation of the known hearing aid is, thus, rendered more difficult.

U.S. Pat. No. 4,476,353, whose disclosure is incorporated herein by reference thereto and which claims priority from German Gebrauchsmuster 81 06 942, discloses a hearing aid of the initially-cited type, wherein the second opening is connected to the first opening and is fashioned as a recess at the inside of the face plate. The second opening fashioned as a recess completely surrounds the first opening. A mounting plate introduced into the second opening or recess completely fills the second opening and, itself, contains an opening that corresponds with the first opening. Due to the size of the mounting lamina that is, therefore, required, the known lamina must be introduced into the second opening of the face plate before the face plate is firmly joined to the housing, for example by gluing. In the connection between the housing and the face plate, the lamina can no longer be removed from the hearing aid.

German Published Application 33 09 175 discloses a hearing aid of the initially-cited type, wherein a box and a volume control form a carriage. The carriage can be introduced perpendicularly to the plane of the face plate through a second opening into a clearance of the hearing aid so that the cover plate comprises a first opening that is closed by a battery drawer or charger in a hinged condition thereof, and wherein the lateral expansion of the first opening forms the second opening. In addition, continuations directed into the hearing aid or ear trough are provided at the edge of the second opening. These continuations comprise guide channels. In order to hold the carriage, the side walls of the carriage are resiliently executed and comprise catch noses at their ends. The holding mechanism for a carriage is extremely involved, because of the resilient fashioning of the side walls and because of the catch noses. Moreover, the latched carriage can be released from the latched position only with a relatively great exertion of force, similar to the case of spot-gluing. The continuations that proceed parallel to one another and project into the hearing aid perpendicular the plane of the face plate will impede service work and can, therefore, be easily damaged.

SUMMARY OF THE INVENTION

It is an object of the present invention to improve the manipulation in a hearing aid, in particular so that the lamina should be reliably held, even when the battery is removed from the battery compartment and should, nonetheless, be removable from the hearing aid without the exertion of great force.

This object is inventively achieved by an in-the-ear hearing aid comprising a housing having a face plate, said face plate having a first opening for a battery compartment and a second opening connected to the first opening for receiving a lamina which is constructed as a carrier for hearing aid components and is introduced so that the lamina is held with two holding mechanisms arranged parallel vis-a-vis one another so as to be displaceable along a path extending parallel to the plane of the face plate.

As a result of the displaceable arrangement of the lamina on the basis of the two holding mechanisms, the lamina can no longer fall into the hearing aid housing as a consequence of changing the batteries. When the battery is removed, the lamina can move in the direction of the opening of the batter compartment within broad limits without falling into the battery compartment, since it is secured against falling out by the two holding mechanisms. According to an especially advantageous development of the invention, at least one holding mechanism is constructed so that a frictional force that is greater than the weight of the lamina occurs when the lamina is displaced. It thereby becomes possible to implement the change of the battery in any arbitrary position or attitude of the hearing aid. In particular, consequently, the surface of the lamina can be held vertically without the lamina being thereby able to dislocate by itself as a consequence of its dead weight including the weight of the hearing aid components mounted thereon. By contrast, however, intentional displacements in the direction of the path proceeding parallel to the plane of the face plate are possible without the exertion of a great force when, for example, the lamina must be removed from the hearing aid in case of repair.

The two holding mechanisms provided in the invention can be fundamentally arranged at arbitrary locations of the lamina and/or at the face plate. It is particularly advantageous with respect to space-saving, as well, when the shape of the lamina is matched to the function of the holding mechanism. In a specific embodiment of the invention, the lamina is limited by the edge for this purpose that comprises two sections arranged parallel to one another and at which constituent parts of the two holders are preferably fashioned of one piece. In a development of the invention, the opening of the face plate that serves for the acceptance of the lamina is, additionally, limited by an edge that comprises two sections arranged parallel to one another and at which constituent parts of the two holding mechanisms are, likewise, preferably fashioned of one piece. An especially advantageous and space-saving fashioning of the two holding mechanisms is thereby achieved. For this purpose, the constituent parts of the holding mechanism that are arranged parallel to one another can comprise glide surfaces that can be displaced relative to one another.

Consequently, glide surfaces, which extend parallel to one another at the lamina, can glide along glide surfaces at the opening of the face plate that correspond therewith and are parallel to one another. These glide surfaces of the invention can be profiled so that only a lateral displacement within the plane of the surface of the lamina in the direction of the opening of the battery compartment is possible. Consequently, an especially effective holding mechanism within the scope of the invention can be realized with simple and, therefore, cost-beneficial means.

Other advantages and features of the invention will be readily apparent from the following description of the preferred embodiments, the drawings and claims.

DESCRIPTION OF THE PREFERRED EMBODIMENTS

Figure 1:
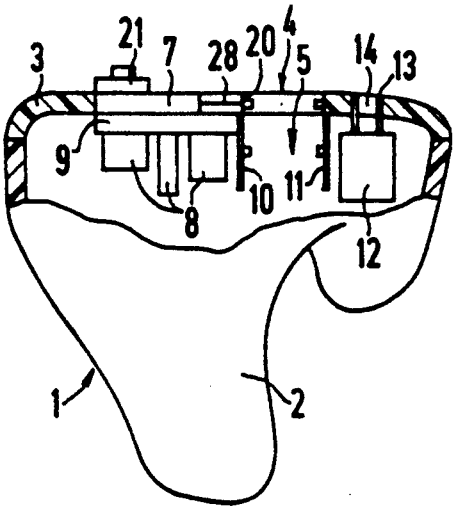
FIG. 1 is a side view of a hearing aid in accordance with the present invention to be worn in the ear, with portions broken away for purposes of illustration.

The principles of the present invention are particularly useful when incorporated in a hearing aid, generally indicated at 1, having a housing 2 that can be worn in the concha of an ear. The housing 2 is non-releasably closed, for example by gluing a face plate 3 that is separately shown in FIG. 2. The face plate 3 comprises a first opening 4 for a battery compartment 5 that extends therebelow. The first opening 4 is connected to a second opening, generally indicated at 6 in FIG. 2. As shown in FIGS. 1 and 3, a lamina 7 can be introduced into the second opening 6. The lamina 7 serves as a carrier for hearing aid components 8 that are arranged on a printed circuit board 9. The lamina 7 or, respectively, the printed circuit board 9 comprises a battery contact spring 10 that simultaneously forms a side wall of the battery compartment 5. A second battery contact spring 11 lies opposite the battery contact spring 10 and forms the other side wall of the battery compartment 5. In the exemplary embodiment of FIG. 1, a hearing aid microphone 12 is held on the face plate 3 via a short hose 13 which is received in an sound entry opening 14. An actuation element 21 as well as a depression or groove 28 and the edge 20 are shown in FIG. 1.

Figure 2:
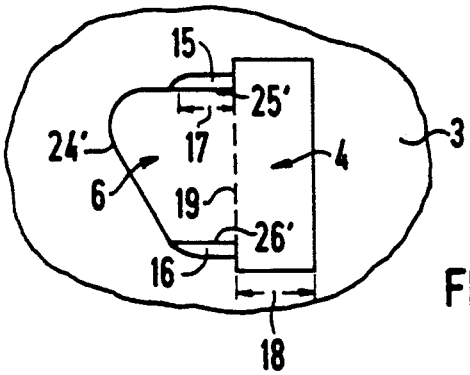
FIG. 2 is a plan view of the face plate of the hearing aid of FIG. 1 with the opening free of lamina and closure members.
Figure 3:
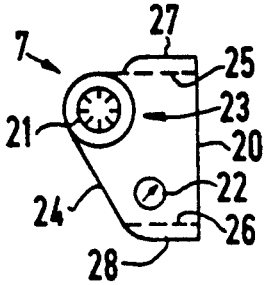
FIG. 3 is a plan view of a lamina contained in the face plate of FIG. 2.

In FIG. 2, the opening 6 is limited by an edge 24' in the face plate 3. This edge 24' comprises two sections 25' and 26', which extend parallel to one another. Projections 15 and 16, which form constituent parts of the two holding mechanisms or means of the invention, are located in these sections 25' and 26'. The lamina 7 is displaceably held in these two projections 15 and 16 which extend parallel to one another. The lamina 7 can be displaced over a distance that roughly corresponds to the distance marked by a double arrow 17. This distance 17 is selected to be greater than 10% and less than 90% of the space available in the first opening 4 to allow displacement of the lamina 7. The available space in the first opening is marked by the double arrow 18. Adequate freedom of movement, thus, remains for the introduction and removal of the lamina 7 into or, respectively, from the hearing aid. A broken line 19 indicates the boundary between the first opening 4 and the second opening 6. When the lamina 7 is introduced into the opening 6, the boundary to the opening 4 is formed by the edge 20 of the lamina 7.

The lamina 7 is separately shown in FIG. 3 with the edge 20. Actuation elements 21 and 22 for adjustable hearing aid components are arranged on the outer surface of the lamina 7. This lamina 7 is bounded by a further edge 24, which has two sections 25 and 26, that are arranged parallel to one another. These sections 25 and 26 each have depressions or grooves 27 and 28, respectively, that form constituent parts of the two holding mechanisms or means. The constituent parts 15 and 16, as well as the depressions 27 and 28 of the two inventive holding mechanisms, are arranged to extend parallel to one another. As a result, the lamina 7 is held displaceable in the region of the distance 17 without being able to drop, for example, into the hearing aid housing. As a result, one holding mechanism is fashioned so that the friction force that is greater than the weight of the lamina 7 including the hearing aid components 8, 9, 21 and 22 arranged thereon occurs upon displacement of the lamina 7 in the opening 6. This can be effected, for example, by a roughened surface of the depressions 27 and/or 28 that are displaceably held in a gliding fashion on the projections 15 and 16, respectively.

As illustrated in FIG. 3, the lamina 7 is limited by the edge 24 that, in combination with the edge 20, comprises an overall shape that approximately corresponds to an upper case letter D of the Roman alphabet, shown in inverted fashion. The opening 6 in the face plate 3 comprises a D-shape corresponding thereto, as illustrated by the edge 24' and the broken line 19 in FIG. 2. At the edge 24, the lamina has a bellied or raised portion that is applied in a region 23 of the lamina 7 and is arranged at a distance from the tragus and, thus, a distance from the antitragus of the ear, as well. This region 23 serves for the acceptance of the actuation element 21 that can be set with a finger. The actuation of the control element 21 is not impeded by the tragus or, respectively, the antitragus as a result of this construction of the lamina 7.

Figure 4:
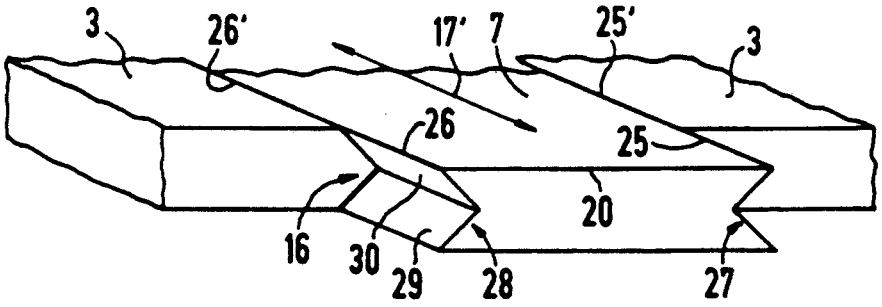
FIG. 4 is a perspective view illustrating the details of a specific embodiment of a holding mechanism in accordance with the present invention.

The holding mechanism between the lamina 7 and the face plate 3 is shown in greater detail in FIG. 4. The lamina 7 is held displaceable in the face plate 3 in the direction of double arrow 17'. To that end, a depression or groove 28 is fashioned in the section 26. This depression or groove 28 engages in a projection 16 on a section 26' of the edge of the face plate 3. These parts form one holding mechanism. An additional corresponding holding mechanism is formed on the other side of the lamina, namely at a section 25, which has a depression 27 arranged thereon that is engaged onto a projection provided in the portion 25' of the edge of the face plate 3. Glide surfaces 29 and 30 are shown for the depression or groove 28, and these extend at an angle relative to one another and, thus, lend the depression 28 a profile that corresponds in cross section to a triangle or a dove tail. Other fashionings or construction of the projections and depression are also possible.

Figure 5A:
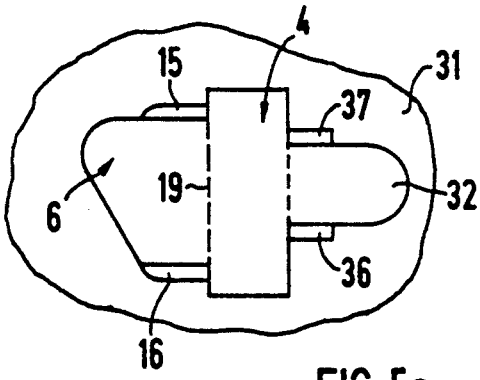
FIG. 5*a* is a plan view of a face plate having an additional opening into which an additional lamina can be introduced with holding mechanisms.
Figure 5B:
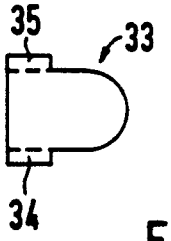
FIG. 5*b* is a plan view of the additional lamina for the additional opening of FIG. 5*a*.

As illustrated in FIG. 5*a*, a modification of the face plate is shown by a face plate 31 that has a first opening 4 and a second opening 6 having the projections 15 and 16. Over and above this, the first opening for the battery compartment is connected to a further or third opening 32. A second or additional lamina 33 (FIG. 5*b*) can be introduced into the opening 32, and this second lamina 33 is, likewise, constructed as a carrier for hearing aid components. The lamina 33 comprises depressions or grooves 34 and 35 that engage into corresponding projections 36 and 37 of the opening 32 when the separately-shown lamina 33 is introduced into the opening 32. The depression 35 and the corresponding projection 37 are constituent parts of the inventive holding mechanism or means, and these additional holding mechanisms of the invention are arranged to extend parallel to each other. Because of these holding means, which are formed by constituent parts 34 and 35 coacting with projections 36 and 37, accessibility of the hearing aid component is, thereby, further improved in case of repair.

Figure 6:
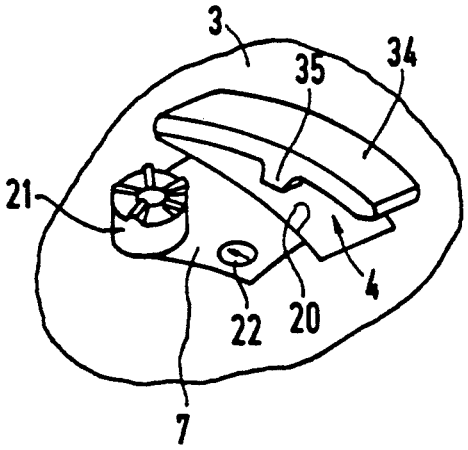
FIG. 6 is a perspective view of the face plate of FIG. 2 having a battery securing device or lid.

In FIG. 6, the face plate 3 has the lamina 7 already inserted. A battery drawer or cover 34 is arranged in a known way over the opening 4 for the battery compartment. This drawer comprises a nose or projection 35. When the battery drawer 34 is closed, the nose 35 presses with a form-fit against the edge 20 of the lamina 7 when it dips into the opening 4. As a result thereof, the lamina 7 is protected against dislocation when the opening 4 is closed. Together with the edge 20 and the lamina 7, the nose 35 of the battery drawer or cover 34, thus, forms a securing device.

Although various minor modifications may be suggested by those versed in the art, it should be understood that we wish to embody within the scope of the patent granted hereon all such modifications as reasonably and properly come within the scope of our contribution to the art.

We claim:

1. A hearing aid for in-the-ear, said hearing aid comprising a housing having a face plate that has a first opening for a battery compartment and a second opening which is connected to the first opening and receives a lamina constructed as a carrier for hearing aid components, said lamina and said second opening together comprising two holding means which have portions extending parallel to each other so that the lamina can be displaceable along a path proceeding parallel to the plane of the face plate.

2. A hearing aid according to claim 1, wherein at least one of the holding means provides a frictional force which is greater than the weight of the lamina to prevent displacement of the lamina

3. A hearing aid according to claim 1, wherein the second opening is limited by an edge of the face plate that comprises sections that are arranged parallel to one another and a constituent of each of the two holding mechanisms is fashioned in these sections.

4. A hearing aid according to claim 1, wherein the lamina is limited by an edge having two sections extending parallel to one another and each of the two holding means has a portion formed in these parallel edge sections.

5. A hearing aid according to claim 1, wherein the two holding means are constructed with the lamina being held displaceable along a distance in the direction of the first opening, wherein the distance is selected to be greater than 10% and less than 90% of the total width of the first opening to enable displacement of the lamina therein.

6. A hearing aid according to claim 1, wherein the lamina is limited by an edge that approximately comprises a shape like an upper case letter D of the Roman alphabet.

7. A hearing aid according to claim 1, wherein the lamina comprises a raised portion that is applied in a region of the lamina distal from the tragus of the ear and serves for the acceptance of actuation elements that can be set with a finger.

8. A hearing aid according to claim 1, wherein the lamina is protected against dislocation by a device that acts on the lamina when the first opening of the battery compartment is closed.

9. A hearing aid according to claim 1, wherein a third opening is connected to the first opening of the battery compartment, said third opening receiving a second lamina constructed as a carrier for hearing aid components.

10. A hearing aid according to claim 9, wherein the second lamina and the third opening have coacting portions forming two additional holding means for holding the lamina in the third opening and allowing movement along the line extending parallel to the face plate.

11. A hearing aid according to claim 1, wherein each of the holding means includes a projection extending in a section of an edge of one of the opening and lamina, and a groove being formed in the other edge of the opening and lamina, said groove receiving said projection and allowing movement only in the direction extending parallel to the length of the groove.

* * * * *